US005656998A

United States Patent [19]

Fujiuchi et al.

[11] Patent Number: 5,656,998

[45] Date of Patent: Aug. 12, 1997

[54] DETECTOR FOR THEFT PREVENTION

[75] Inventors: Hiroyuki Fujiuchi; Masaaki Takeshita; Kenji Uchida, all of Osaka; Tsutomu Ida; Hisakazu Okumura, both of Tomioka; Mitsuhiko Nakajima, Nagano-ken, all of Japan

[73] Assignee: Kubota Corporation, Osaka, Japan

[21] Appl. No.: 428,241

[22] PCT Filed: Aug. 25, 1994

[86] PCT No.: PCT/JP94/01405

§ 371 Date: Apr. 26, 1995

§ 102(e) Date: Apr. 26, 1995

[87] PCT Pub. No.: WO95/06922

PCT Pub. Date: Mar. 9, 1995

[30] Foreign Application Priority Data

| | | | |
|---|---|---|---|
| Aug. 31, 1993 | [JP] | Japan | 5-215882 |
| Aug. 31, 1993 | [JP] | Japan | 5-215883 |
| Aug. 31, 1993 | [JP] | Japan | 5-215884 |

[51] Int. Cl.[6] ..... G08B 13/02; G08B 13/181

[52] U.S. Cl. ..... 340/571; 340/568; 340/572; 70/57.1

[58] Field of Search ..... 340/572, 571, 340/568; 70/57.1

[56] References Cited

U.S. PATENT DOCUMENTS

| | | | |
|---|---|---|---|
| 3,253,271 | 5/1966 | Trupiano | 340/528 |
| 4,000,543 | 1/1977 | Paskert | 340/572 |
| 4,274,088 | 6/1981 | Pierson et al. | 340/568 |
| 4,987,754 | 1/1991 | Minasy | 70/57.1 |
| 4,992,776 | 2/1991 | Crossfield | 340/572 |

FOREIGN PATENT DOCUMENTS

| | | | |
|---|---|---|---|
| 52-82094 | 7/1977 | Japan . | |
| 55-89192 | 12/1978 | Japan . | |
| 61-160583 | 10/1986 | Japan . | |
| 62-285328 | 12/1987 | Japan . | |
| 63-195493 | 12/1988 | Japan . | |
| 2-260098 | 10/1990 | Japan . | |
| 4-108286 | 3/1991 | Japan . | |
| 4-20192 | 2/1992 | Japan . | |
| 4-211897 | 8/1992 | Japan . | |
| 2205426 | 12/1988 | United Kingdom | G08B 13/00 |
| WO91/13416 | 9/1991 | WIPO | G08B 21/00 |

*Primary Examiner*—Glen Swann

*Attorney, Agent, or Firm*—Townsend and Townsend and Crew LLP

[57] ABSTRACT

The present invention relates to a detector for theft prevention used in contact with a commodity or the like exhibited in a shop.

Conventionally, an operated portion for contacting a commodity or the like is pivotable only in one direction from a projected position. The commodity or the like cannot be moved in directions requiring the operated portion to pivot in directions other than that direction. A forcible movement would damage the operated portion.

In a detector for theft prevention of this invention, a switch (3) provided for a box (2) thereof has a pivotable operated portion (3*a*) biased to return to a position projecting from a surface (2*c*, 2*d*) contacting an object of theft prevention (E). The operated portion (3*a*) is pivotable in a plurality of directions including at least two opposite directions (e1, e2). The detector for theft prevention is properly operable for movements in varied directions of the object of theft prevention (E).

10 Claims, 16 Drawing Sheets

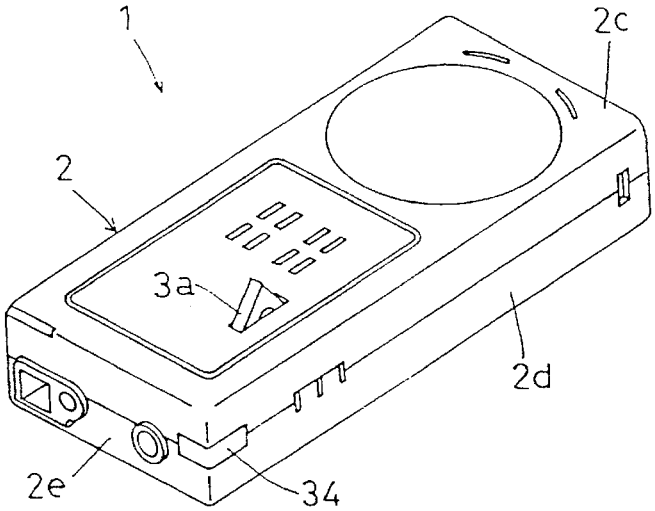
FIG. 2A
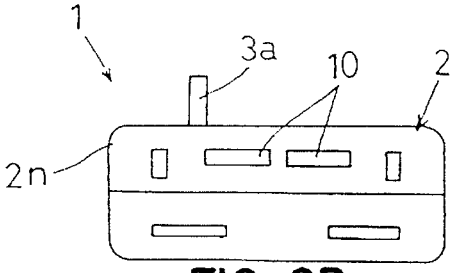
FIG. 2B
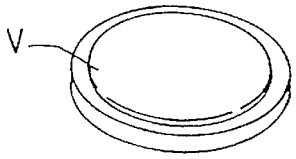
FIG. 3
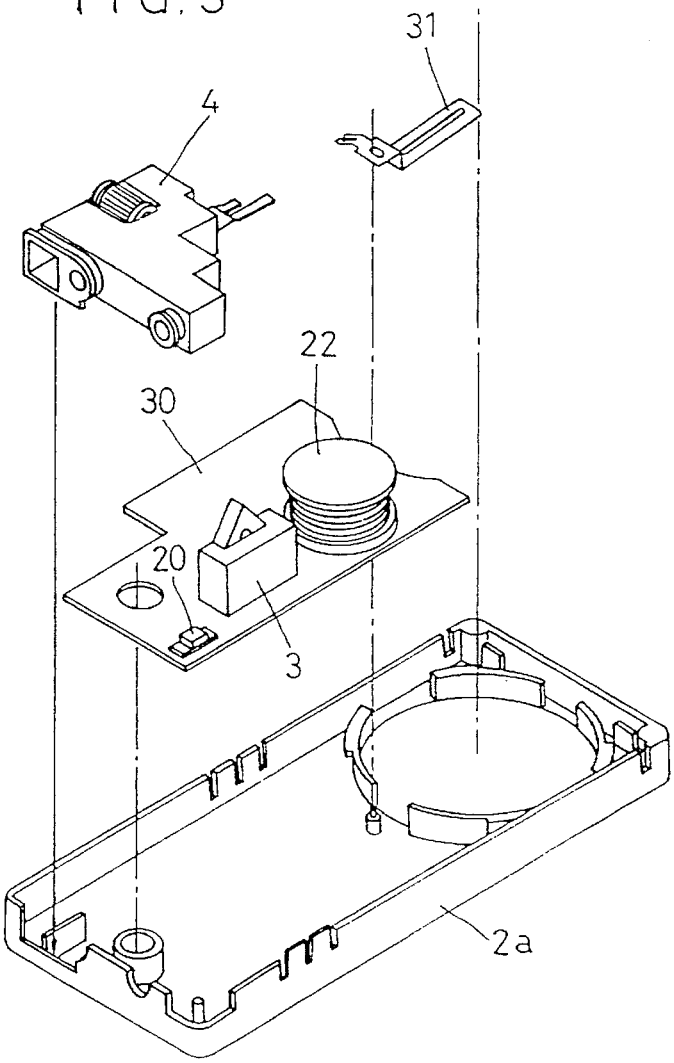

FIG. 10
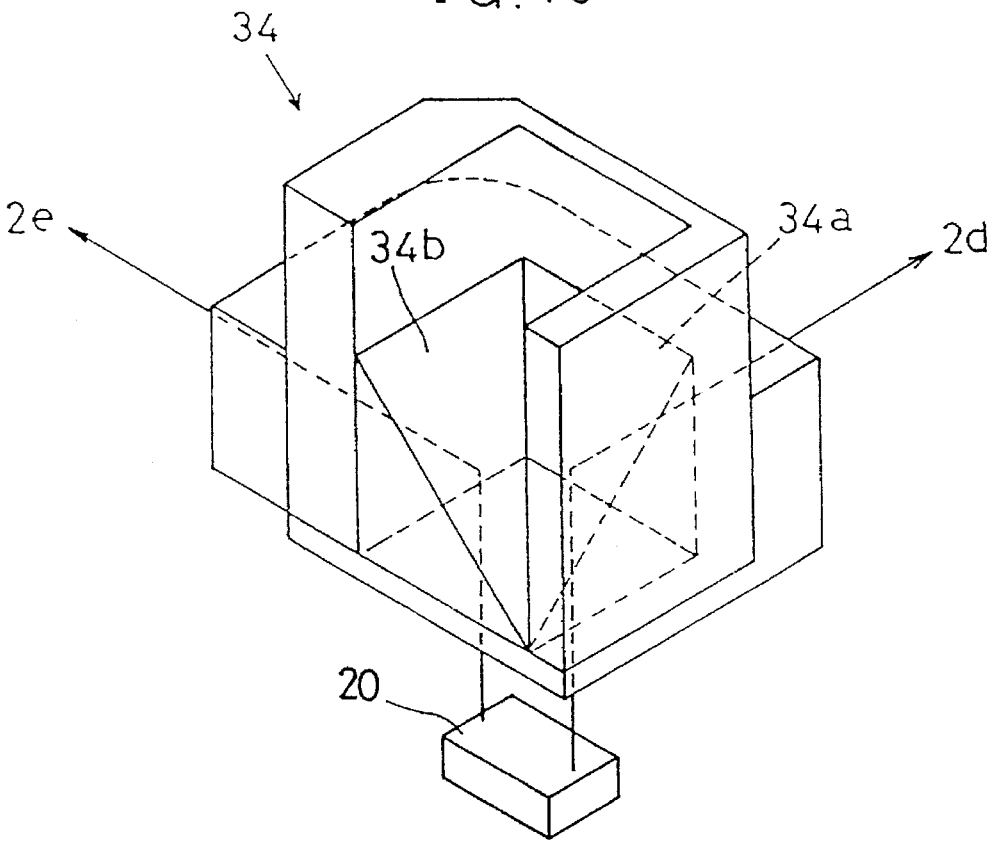
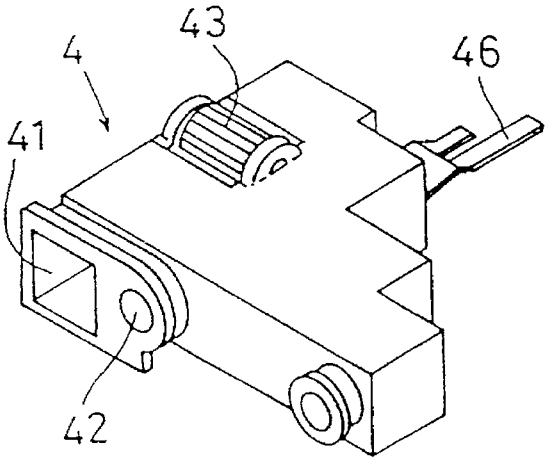
FIG. IIA
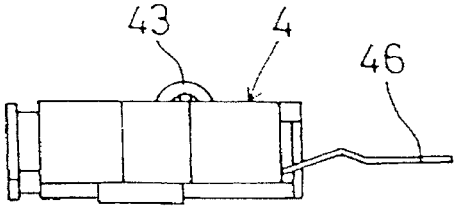
FIG. IIB

FIG. 23
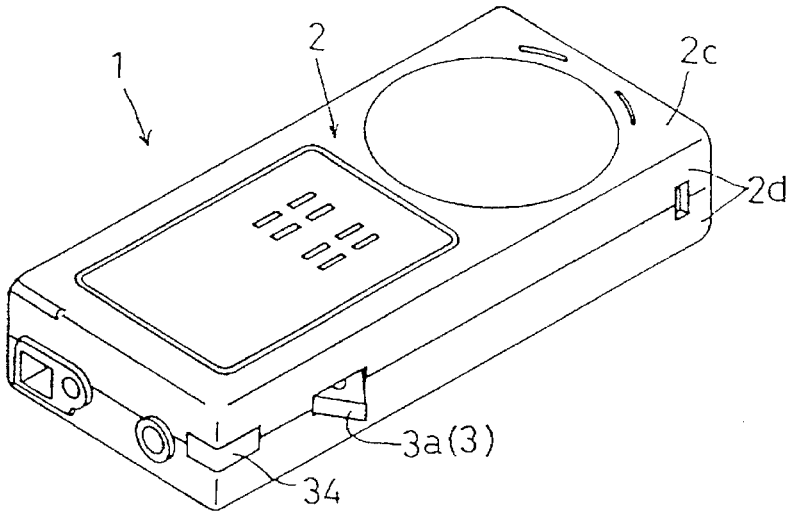
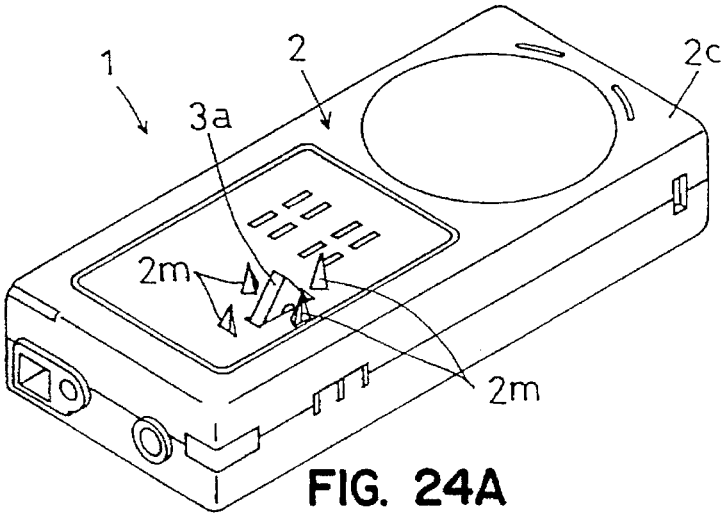
FIG. 24A
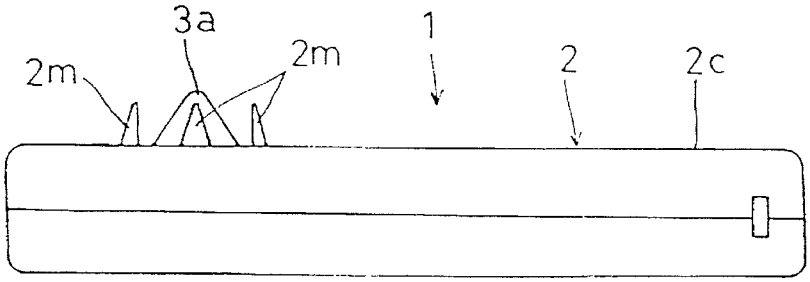
FIG. 24B

DETECTOR FOR THEFT PREVENTION

TECHNICAL FIELD

The present invention relates to a detector for theft prevention comprising a box attached in contact with an object of theft prevention, and a switch attached to this box for detecting whether it has been detached from the object of theft prevention.

BACKGROUND ART

A theft preventive device comprising such a detector for theft prevention is used in contact with an object of theft prevention such as a commodity displayed in a shop, for example; The detector for theft prevention detects whether the theft preventive device has been detached from the object of theft prevention, and sounds an alarm.

As shown in FIG. 25, for example, a theft preventive device 100 is mounted in a case 101 to protect, from shoplifting, an object of theft prevention E such as a compact disk. The object of theft prevention E is inserted into the case 101 to contact the theft preventive device 100 (see, for example, Utility Model Application No. 3-11054 filed by Applicant).

A switch is provided for the theft preventive device as a detector for theft prevention to detect whether the theft preventive device has been detached from the object of theft prevention then. The switch has a pivotable operated portion biased to return to a position projected from a contact surface of the object of theft prevention. However, as shown in FIG. 26, the conventional operated portion can pivot only to one side from the projected position.

In the figure, 3' denotes a conventional switch having an operated portion 3*a'*, and 102 denotes an alarm generator.

Since the conventional operated portion is pivotable only to one side from the projected position, the object of theft prevention cannot be moved in a direction that pivots the operated portion in a direction other than that direction.

Thus, when inserting the object of theft prevention E into the case 101, the object of theft prevention E is moved in a direction f1 as shown in FIG. 26. When removing the object of theft prevention from the case 101, the object of theft prevention E is moved in a direction f2. If the object of theft prevention E has an uneven contact surface (lower surface), the operated portion 3*a'* is caught on the unevenness when the object of theft prevention E is moved out of the case 101. Thus, the object of theft prevention E cannot be taken out. When an attempt is made to take out the object of theft prevention E forcibly, the operated portion 3*a'* could be damaged inadvertently.

An object of the present invention is to provide a detector for theft prevention that eliminates the drawbacks of the prior art noted above.

More particularly, the invention intends to provide a detector for theft prevention operable properly with regard to various directions of movement of an object of theft prevention, for example.

Furthermore, the invention intends to provide a detector for theft prevention having little chance of malfunction, capable of reliably detecting whether a theft preventive device has been detached or not, and having a high yield of manufacture.

DISCLOSURE OF THE INVENTION

A detector for theft prevention according to the present invention comprises a box attached in contact with an object of theft prevention, and a switch provided for this box for detecting whether it is detached from the object of theft prevention, the detector for theft prevention being characterized in that the switch provided for the box has a pivotable operated portion biased to return to a position projecting from a surface contacting the object of theft prevention, the operated portion being pivotable in a plurality of directions including at least two opposite directions.

With this construction, the operated portion is pivotable in a plurality of directions including at least two opposite directions. Even when the object of theft prevention moves in two opposite directions (e.g. in directions e1, e2 in FIG. 21), the operated portion pivots in accordance with pushed states (moving states) of the object of theft prevention.

Consequently, since the operated potion pivots in accordance with pushed states (moving states) of the object of theft prevention, the detector for theft prevention is properly operable for movements in varied directions of the object of theft prevention.

The contact surface may have a plurality of projections surrounding the operated portion to extend into the object of theft prevention With this construction, where the theftobject of theft prevention preventive device is attached to an object of theft prevention such as a cardboard box, the plurality of projections surrounding the operated portion on the contact surface with the object of theft prevention am extended into the object of theft prevention. Thus, it is possible to detect a preliminary stealing act to insert a thin plate-like foreign object such as a ruler between the theft preventive device and object of theft prevention in order not to allow the operated portion to project from the contact surface. That is, when a thin plate-like foreign object is inserted between the theft preventive device and object of theft prevention, the foreign object ride on the plurality of projections, whereby the operated portion projects from the contact surface.

Consequently, since it is possible to detect a preliminary stealing act to insert a foreign object in order not to allow the operated portion to project from the contact surface, the theft prevention detector can positively detect whether the object of theft prevention is removed or not.

The box of the theft prevention detector of this invention may have receiver means for receiving a medium of information communication transmitted from a transmitter installed in a predetermined position, and an alarm sound output means for outputting an alarm sound based on detection information from the receiver means.

This construction is effective to detect a theft with increased reliability by means of the alarm sound.

It is preferable that the alarm sound output means does not send the medium for information communication transmitted from the transmitter.

With this construction, when the alarm sound output means operates to sound the alarm, it does not send the same medium as the medium for information communication transmitted from the transmitter installed in a predetermined location. Thus, even where theft preventive devices are disposed close to one another, the operation of the alarm sound output means does not cause malfunctioning of the receiver means of the other theft preventive devices.

Consequently, since the operation of the alarm sound output means does not cause malfunctioning of the receiver means of the other theft preventive devices, malfunctioning of the theft preventive devices is avoided to promote reliability of the theft preventive devices.

Further, the alarm sound output means may comprise a piezoelectric buzzer.

With this construction, since a piezoelectric buzzer is used as the alarm sound output means, the alarm sound output means may be formed thin and lightweight.

Consequently, the theft preventive device may be formed thin and lightweight.

Further, the box may have a battery for supplying electricity to the alarm sound output means and the alarm sound output means opposed to each other therein, and a plate-like terminal unit having a terminal connected to an electrode of the battery and a terminal connected to an electrode of the alarm sound output means is provided between the battery and the alarm sound output means.

In this construction, the battery (button type or coin type) and piezoelectric buzzer are opposed to each other, and a plate-like terminal unit having a terminal connected to an electrode of the battery and a terminal connected to an electrode of the piezoelectric buzzer is provided between the battery and piezoelectric buzzer. Thus, three types of flat components (battery, piezoelectric buzzer and terminal unit) are arranged in superposition within the box.

Consequently, the theft prevention apparatus may be formed very thin.

Further, the alarm sound output means may output an intermittent sound as alarm sound.

This construction facilitates recognition of the alarm sound of the theft preventive device, and reduces power consumption of the theft preventive device, there by promoting efficiency of the theft preventive device.

Consequently, shop assistants and the like recognizes the alarm sound with ease. Power consumption of the theft preventive device is less than where the alarm sound is outputted any time.

The box may have sound release openings formed in a side surface thereof for releasing the alarm sound outputted from the alarm sound output means outside said box.

With this construction, the alarm sound outputted from the alarm sound output means is released through the openings in the side surface of the box. The alarm sound release openings are difficult to block up, compared with the case where such openings are formed in a front surface or bottom surface of the box. That is, when the theft preventive device is formed thin, the side surfaces of the box have a smaller width than the front surface and bottom surface. If the openings were formed in the front surface or bottom surface of the box, it would be possible to block up the openings easily with fingers or the like (such an act is taken to stifle the alarm sound). However, the openings are difficult to block up by providing the openings in the side surface of the box.

Consequently, it is now possible to prevent effectively a preliminary stealing act to take the object of theft prevention outside the shop, with fingers blocking up the openings to suppress the alarm sound.

The box may have a shield wall mounted therein for shielding components in the box against exposure through the openings.

With this construction, since the shield wall is provided to shield components in the box against exposure through the openings, the shield can bar entry of a foreign object inserted through an opening into the box. The alarm sound generated in the box is guided round the shield wall to the openings to be released outside the box.

Consequently, it is now possible to prevent effectively a preliminary stealing act to destroy the components in the box by inserting a foreign object through an opening.

Further, the present invention may be modified such that the receiver means comprises a resonance antenna for a theft preventive device for outputting a signal to operate the alarm means upon receipt of the electric wave from the transmitter, and has a coil, a capacitor and a resistor in parallel connection.

With this construction, the resistor is connected in parallel to the coil and capacitor already in parallel connection. This resonance antenna has what is known as Q-value of a resonator lowered, whereby the resonance antenna has a reduced frequency selectivity. Thus, the reception sensitivity of the resonance antenna is little variable with variations in resonance frequency due to variations in circuit constant caused by variations in the coil and capacitor.

With this construction, therefore, the reception sensitivity of the resonance antenna is little variable with variations in resonance frequency. This minimizes variations in reception sensitivity occurring with different resonance antennas, thereby to promote yield in the manufacture of resonance antennas for use in theft preventive devices.

BRIEF DESCRIPTION OF THE DRAWINGS

FIG. 3 is an explanatory perspective view of a bottom case component in the embodiment of FIG. 1, FIG. 10 is a perspective view of an LED window in the embodiment of FIG. 1, FIGS. 11(*a*), (*b*) are explanatory views of outward appearances of a jack unit the embodiment of FIG. 1, FIGS. 12(*a*), (*b*) are explanatory views of a set button pin in the embodiment of FIG. 1, FIG. 23 is an explanatory view of an outward appearance of a theft preventive device in another embodiment, FIGS. 24(*a*), (*b*), are explanatory views of outward appearances of a theft preventive device in a further embodiment.

BEST MODE FOR CARRYING OUT THE INVENTION

An embodiment of the present invention will be described hereinafter with reference to the drawings.

Figure 25:
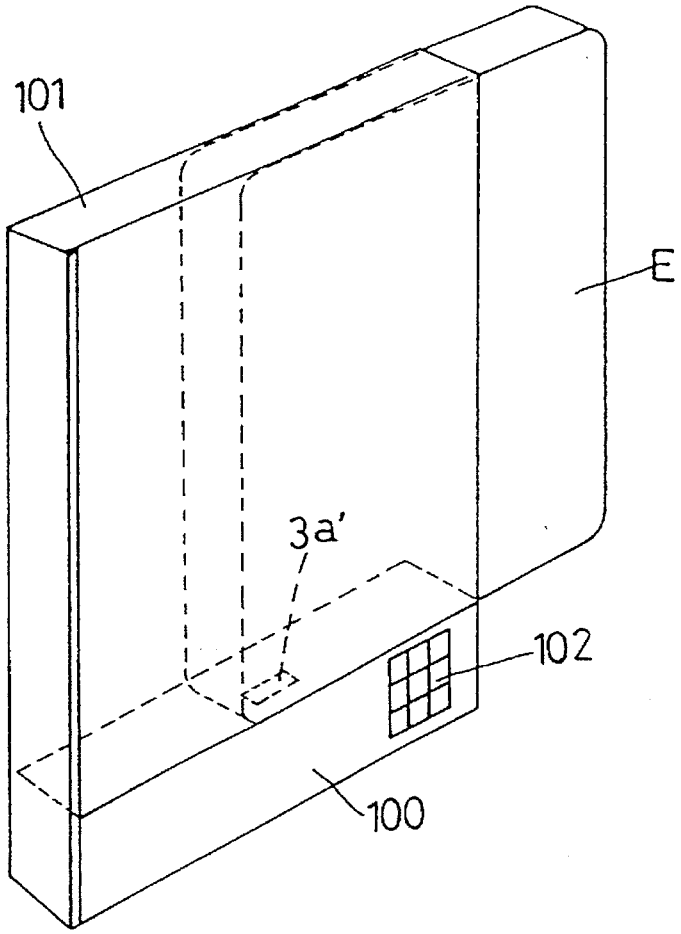
FIG. 25 (PRIOR ART)
FIG. 25 is a perspective view of a theft preventive device known in the art.
Figure 26:
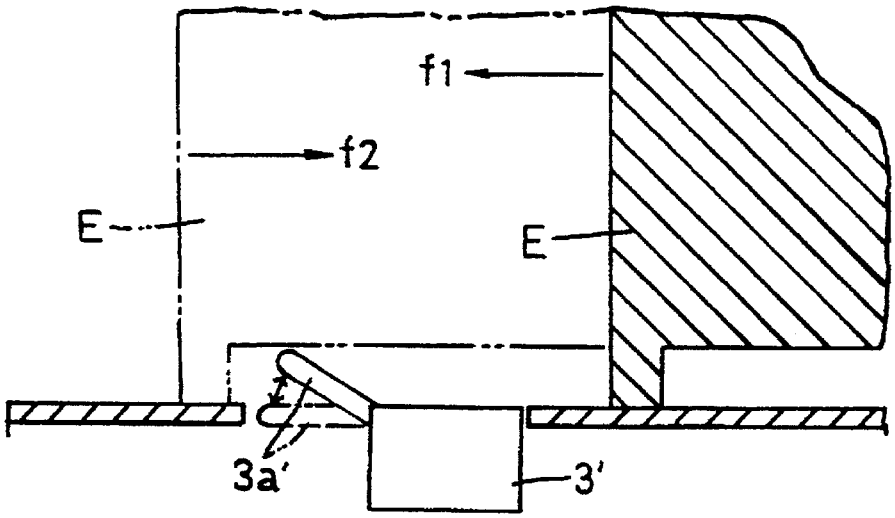
FIG. 26 (PRIOR ART)
FIG. 26 is an explanatory view of operation of a switch in the in the known theft preventive device.

As shown in FIG. 2, a sensor tag 1 acting as a theft preventive device includes a box 2 attached with a top surface (contact surface) thereof contacting an object of theft prevention E (FIGS. 25 & 26). FIG. 2(*a*) is a perspective view of the sensor tag 1, and FIG. 2(*b*) shows a rear surface 2*n* of the sensor tag 1.

The sensor tag 1 includes a switch 3 having a pivotable operated potion 3*a* biased to a projection position projected from the contact surface 2*c*. This switch 3 is turned ON/OFF by pivotal movement of the operated portion 3*a*. Consequently, the operated portion 3*a* of the switch 3 pivots by presence or absence of the object of theft prevention E to turn the switch 3 ON/OFF, to detect whether the sensor tag 1 has been detached from the object of theft prevention or not.

Figure 1:
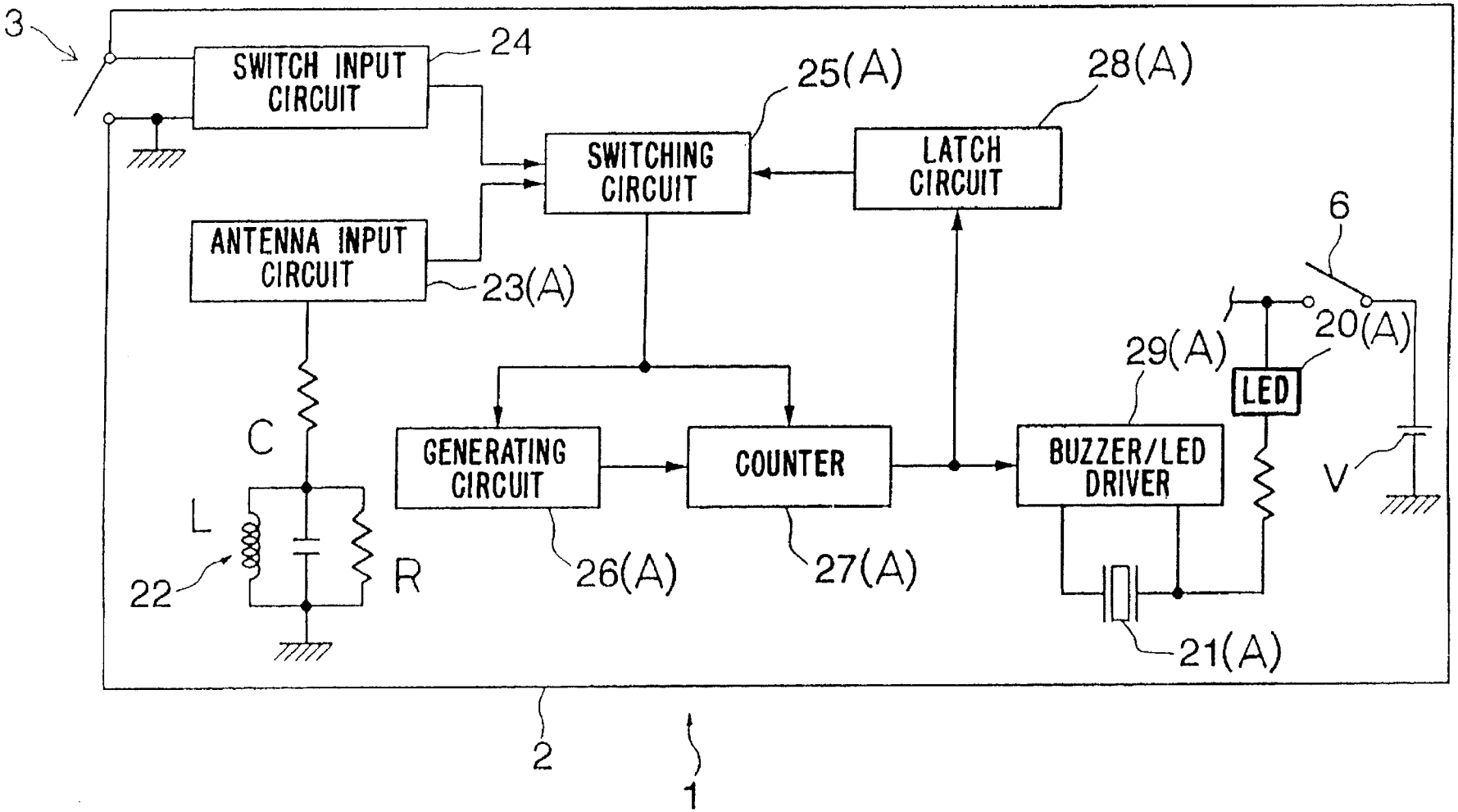
FIG. 1 is a schematic view of a theft preventive device in an embodiment of the present invention, FIGS. 2(*a*), (*b*) are explanatory views of outward appearances of the theft preventive device of FIG. 1.

As shown in FIG. 1, the box 2 of sensor tag 1 contains an LED lamp (chip LED) 20 acting as a light emitting device; a piezoelectric buzzer 21; a resonance antenna 22 including a cell E, a capacitor C and a resistor R; an antenna input circuit 23 for outputting a reception signal when the resonance antenna 22 is in signal receiving state; a switch input circuit 24 for outputting OFF signal indicating OFF state of switch 3; a switching circuit 25 for outputting a control signal upon receipt of the reception signal from the antenna input circuit 23 or OFF signal from the switch input circuit 24; a generating circuit 26 which starts generating pulses upon input of the control signal from the switching circuit 25; a counter 27 which starts counting the pulses generated by the generating circuit 26 upon input of the control signal from the switching circuit 25, and outputs a count completion signal when the count exceeds a predetermined number; a latch circuit 28 responsive to input of the count completion signal to maintain switching circuit 25 in the state of receiving the above reception signal or OFF signal; a buzzer/LED driver 29 acting as a drive device to light the LED lamp 20 and sound the piezoelectric buzzer 21 upon input of the count completion signal of counter 27; a flat battery (button type or coin type) V for supplying power to the respective circuits in the box 2; and a power supply switch 6 for turning on and off the power supply from the battery V to the circuits.

Figure 20:
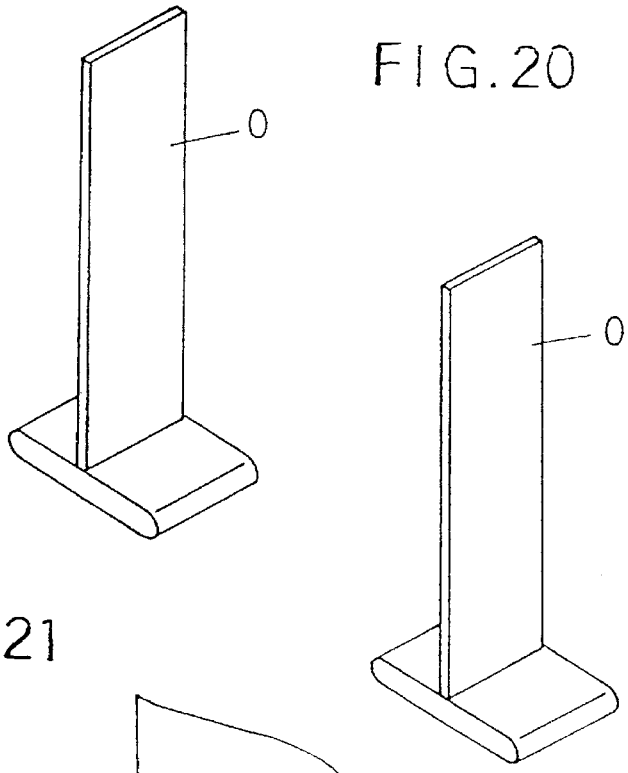
FIG. 20 is a perspective view of an outward appearance of a transmitter in the embodiment of FIG. 1.
Figure 21:
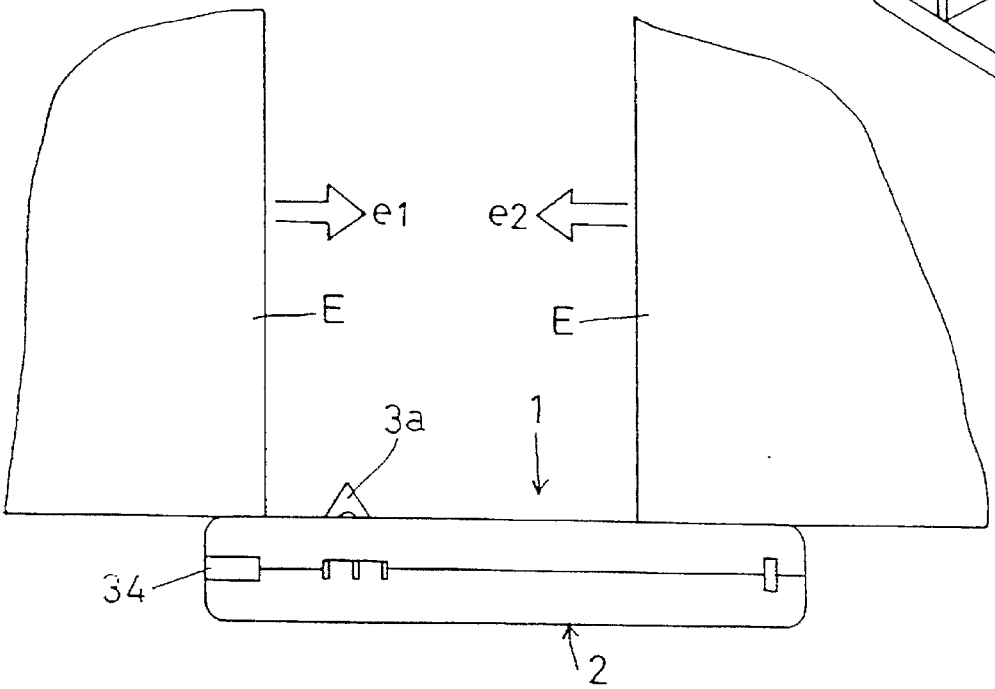
FIG. 21 is an explanatory view of operation of the switch in the embodiment of FIG. 1.

In the circuit having the above construction, the piezoelectric buzzer 21 mounted in the box 2 sounds when, with the power supply switch 6 turned on, the switch 3 is turn off, or the sensor tag 1 is passed through a position where a pair of panel-like transmitters O as shown in FIG. 20 are installed at opposite sides of an entrance of a shop. One of the panel-like transmitters O may be installed at one side of the entrance, or on a floor of the entrance.

In FIG. 2, 10 denotes openings formed in a side surface 2*n* of the box 2 for releasing the sound of the piezoelectric buzzer 21 outwardly of the box 2.

The resonance antenna 22 has its reception sensitivity adjusted beforehand according to an expected spacing with which the pair of transmitters O are installed.

The adjustment of reception sensitivity can be carded out in two ways.

The reception sensitivity of resonance antenna 22 increases linearly with an increase in the resistance value of resistor R. Accordingly, one of the two methods is carried out by appropriately changing the resistor R to one having a suitable resistance value.

When the resistance value of the resistor is changed, Q value of the resonance antenna changes with the resistance value, and the reception sensitivity of the resonance antenna changes with it.

On the other hand, the resonance frequency of the resonance antenna does not change even if the resistance value of the resistor is changed. Thus, the change of reception sensitivity by a change of resonance frequency need not be taken into account.

In adjusting the reception sensitivity of the resonance antenna, it is unnecessary to consider a change in reception sensitivity due to a change in resonance frequency. The reception sensitivity of the resonance antenna can, therefore, be adjusted easily.

Figure 22:
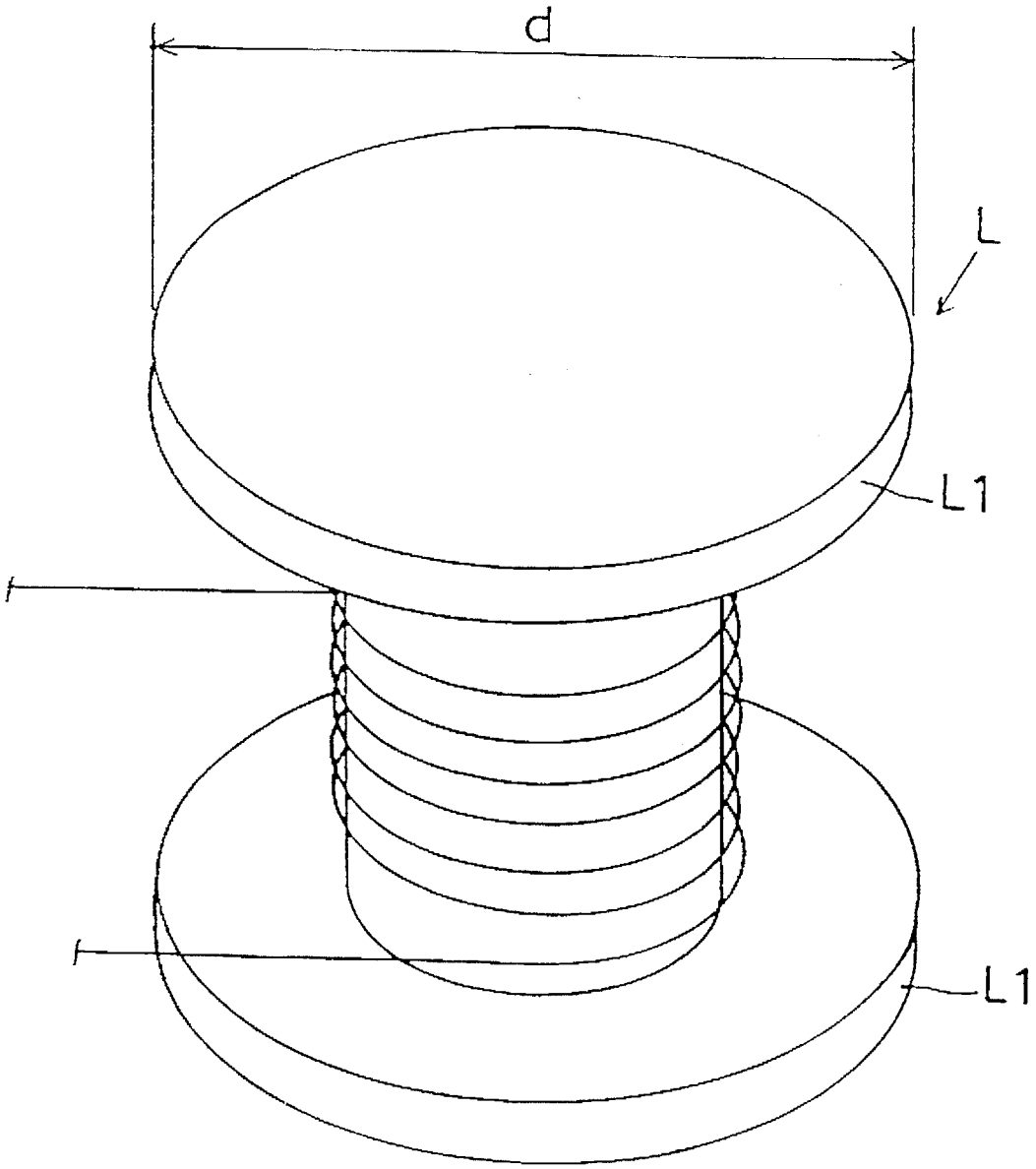
FIG. 22 is an enlarged view of a coil in the embodiment of FIG. 1.

The coil L has a drum type core L1 as shown in FIG. 22. The reception sensitivity of resonance antenna 22 increases linearly with an increase in flange diameter d of drum type core L1. The other method is carded out by using a core having a suitable flange diameter d. Even if flange diameter d is changed, the inductance of coil L should be maintained substantially fixed.

When the flange diameter of the drum type core of the coil is varied, the convergence effect of magnetic flux by the coil changes, which in turn changes the reception sensitivity of the resonance antenna.

On the other hand, the resonance frequency of the resonance antenna does not change with a change in the above flange diameter if the inductance value of the coil is fixed. Accordingly, a change in reception sensitivity due to a change in resonance frequency need not be considered.

Thus, in adjusting the reception sensitivity of the resonance antenna, a change in reception sensitivity due to a change in resonance frequency need not be considered. The reception sensitivity of the resonance antenna can be adjusted easily.

Next, a process for causing the piezoelectric buzzer 21 to begin to sound will be described briefly.

The sensor tag 1 is attached to object of theft prevention E, with the switch 3 turned ON to set in operative state (to turn on the switch 6). When the sensor tag is detached from the object of theft prevention E, the switch 3 becomes OFF. The switch input circuit 24 detects the OFF state.

Upon detection of the OFF state of switch 3, the switch input circuit 24 outputs the OFF signal to the switching circuit 25.

While the OFF signal is inputted from the switch input circuit 24, the switching circuit 25 sends the control signal to the generating circuit 26 and counter 27. While the control signal is received, the generating circuit 26 generates pulses, and the counter 27 counts the pulses generated by the generating circuit 26. When the control signal stops, the generating circuit 26 stops generating pulses, and the counter 27 stops counting and resets a pulse count.

Each time a predetermined count of pulses is reached, the counter 27 sends one pulse signal as a count completion signal to the latch circuit 28 and buzzer/LED driver 29.

While this count completion signal is received, the buzzer/LED driver 29 sounds the piezoelectric buzzer 21, and flashes the LED lamp 20.

On the other hand, the latch circuit 28 receives the count completion signal from the counter 27, and maintains the switching circuit 25 in the state of receiving the above OFF signal. The switching circuit 25 thereby continues sending the control signal to the generating circuit 26 and counter 27.

In other words, the buzzer/LED driver 29 sounds the piezoelectric buzzer 21 and lights the LED lamp 20 after the switching circuit 25 receives the OFF signal and the counter 27 completes counting up to the predetermined count. Thus, unless the OFF signal is continuously received over a fixed time, the piezoelectric buzzer 21 and LED lamp 20 remain out of operation. The prevents malfunctioning due to noise or the like.

The switching circuit 25 continues sending the control signal once the counter 27 outputs the count completion signal, regardless of presence or absence of the OFF signal from the wire unit input circuit 24. As a result, until the power supply switch 6 is turned off, the piezoelectric buzzer 21 continues outputting intermittent sound synchronously with the count completion signal from the counter 27, and the LED lamp 20 continues flashing synchronously with the count completion signal from the counter 27.

On the other hand, when the sensor tag 1 passes through a position where the transmitters O are installed, the resonance antenna 22 generates an electromotive force with an electric wave from the transmitters O. The antenna input circuit 23 detects the electromotive force, and outputs the reception signal to the switching circuit 25.

The operation of each circuit after the switching circuit 25 receives the reception signal is the same as when the above-mentioned switch 3 becomes OFF state, and will not be described again.

Thus, the resonance antenna 22 acts as a reception device for receiving a medium (electric wave) of information communication sent from the transmitters installed in a particular location. The piezoelectric buzzer 21 acts as an alarm sound output device to output an alarm sound based on reception information of the reception device (resonance antenna 22), but not to transit the medium (electric wave) of information communication sent from the transmitters O installed in the particular location.

The antenna input circuit 23, switching circuit 25, generating circuit 26, counter 27, latch circuit 28, buzzer/LED driver 29, LED lamp 20 and piezoelectric buzzer 21 act as an alarm device A operable upon receipt of the signal from the resonance antenna 22.

The construction and operation of each component will be described hereinafter.

Figure 4:
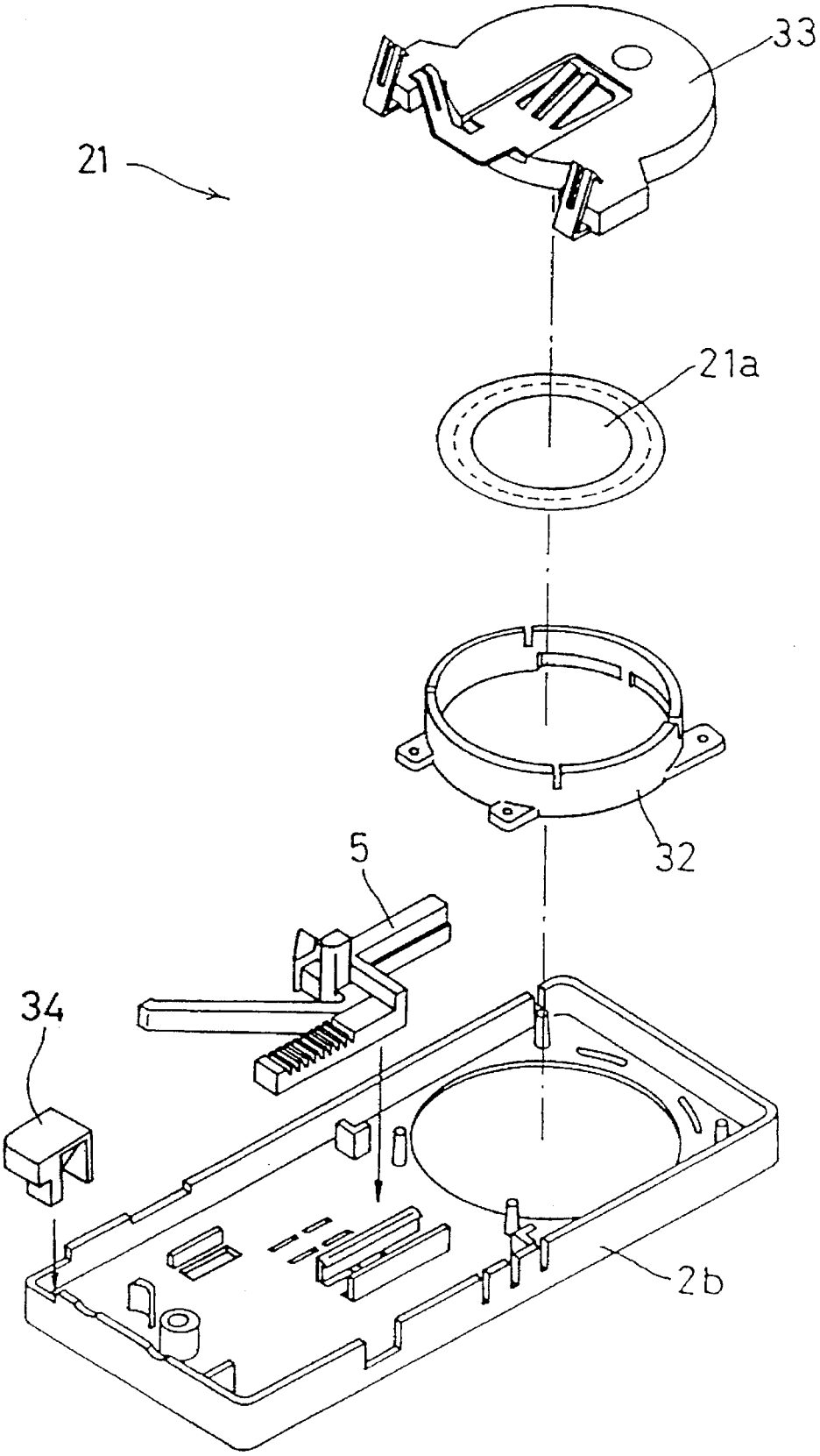
FIG. 4 is an explanatory perspective view of top case components in the embodiment of FIG. 1.

As shown in FIGS. 3 and 4, the box 2 includes a bottom case **2*a* and a top ease 2*b***.

The bottom case **2*a* has a circuit board 30 carrying the switch 3, LED lamp 20, antenna 22 and various electronic components, a jack unit 4, a terminal 31** for plus electrode connection of battery V, and the battery V.

The top case **2*b* has, assembled thereto, the piezoelectric buzzer 21 formed of a piezoelectric vibration plate 21*a*, a speaker housing 32 and a terminal unit 33, an LED window (light window) 34 for releasing light from the LED lamp 20, and a slider 5. The sensor tag 1 shown in FIG. 2 is formed by joining the bottom case 2*a* and top case 2*b*** by ultrasonic welding.

Figure 6A:
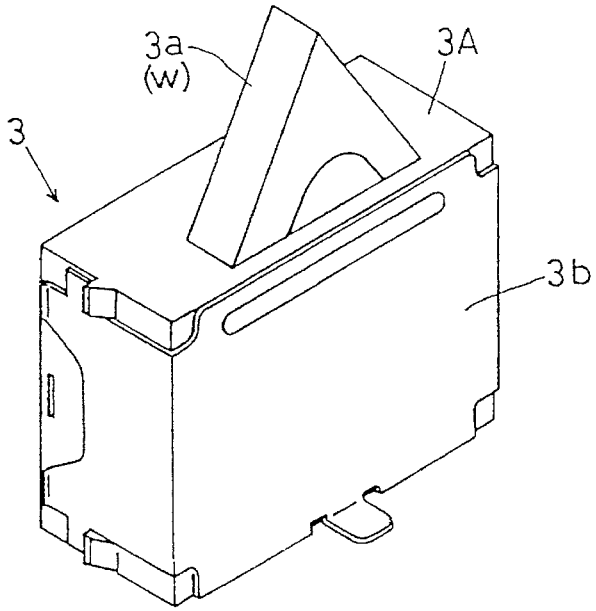
Figure 6B:
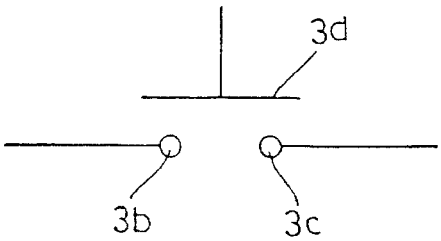
Figure 7A:
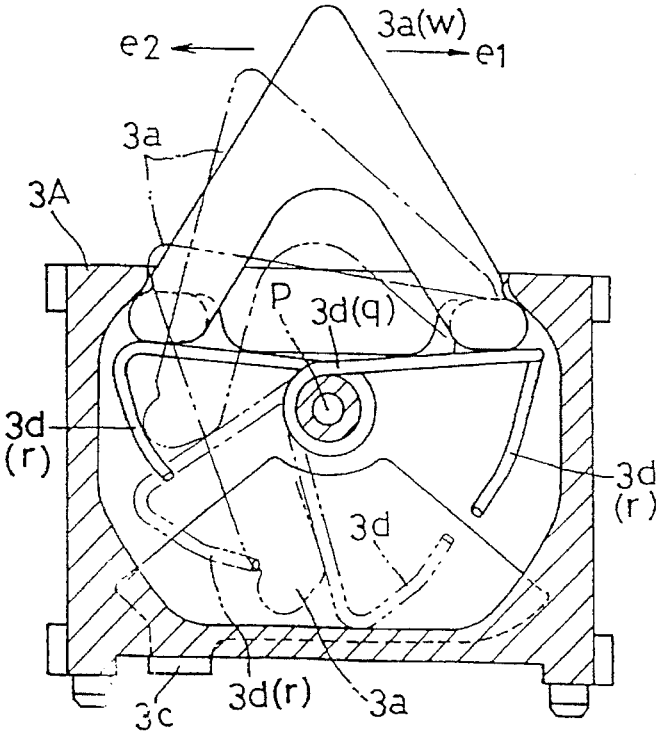
Figure 7B:
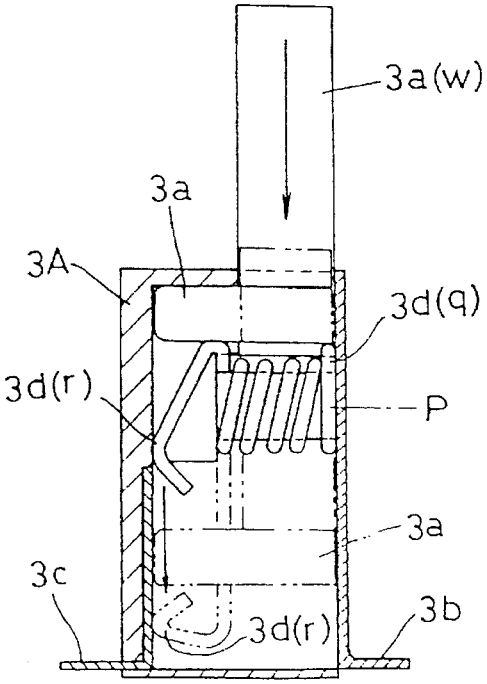

As shown in FIGS. 6 and 7, the switch 3 includes a box-like frame 3A formed of a non-conductive material such as a resin to define an open side; the substantially triangular operated portion **3*a* with one end thereof projecting upwardly of the contact surface; a substantially C-shaped first terminal plate 3*b* formed of metal and attached to the frame 3A to dose the opening; a second terminal plate 3*c* formed of metal and attached to an inner surface of the frame 3A; and a coil spring 3*d* acting as an elastic device supported on a boss defined by the frame 3A to be pivotable about a cross axis P. The operated portion 3*a* is held between the frame 3A and coil spring 3*d* to be pivotable in two opposite directions e1, e2 and biased to projection position w projecting from the upper surface of the frame 3A by opposite end portions of coil spring 3*d*** extending from a middle portion q thereof.

The operated portion **3*a* projects from the contact surface 2*c* when the switch 3 is initially mounted in the box 2**.

Further, the coil spring **3*d* acts as a connection terminal for connecting and disconnecting the first terminal plate 3*b* and second terminal plate 3*c* of switch 3. That is, the middle portion q of coil spring 3*d* constantly is in elastic contact with the first terminal plate 3*b*. When the operated portion 3*a* pushes down an end r of coil spring 3*d*, the end r of coil spring 3*d* moves into contact with the terminal plate 3*c***.

The operated portion **3*a* is pivotable in the two opposite direction e1, e2. Even if the object of theft prevention E moves in the two opposite directions e1, e2 as shown in FIG. 7, the operated portion 3*a* can operate the switch 3** properly in response to the movement of the object of theft prevention E.

FIG. 6(*a*) is a perspective view of switch 3, and (*b*) is a view showing a circuit construction of switch 3. FIGS. 7(*a*), (*b*) are sectional side views of switch 3.

Figure 8A:
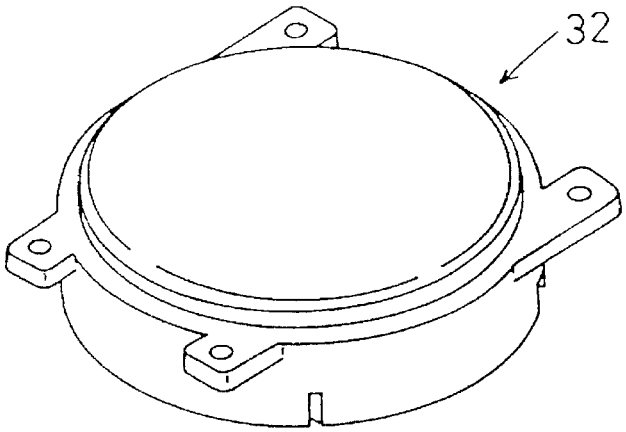
Figure 8B:
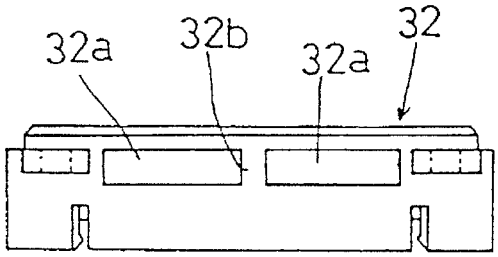
Figure 9A:
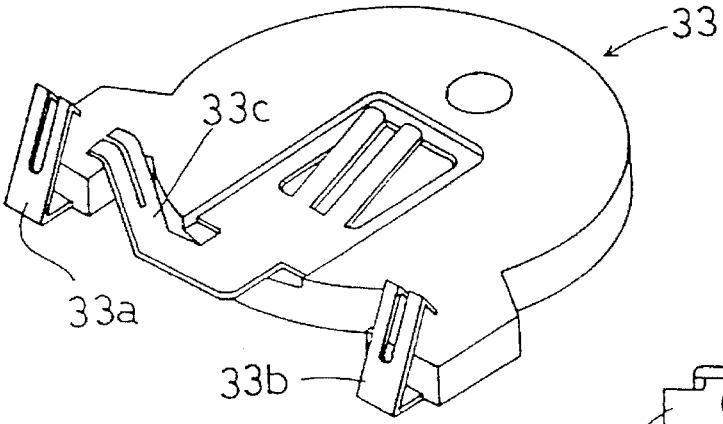
Figure 9B:
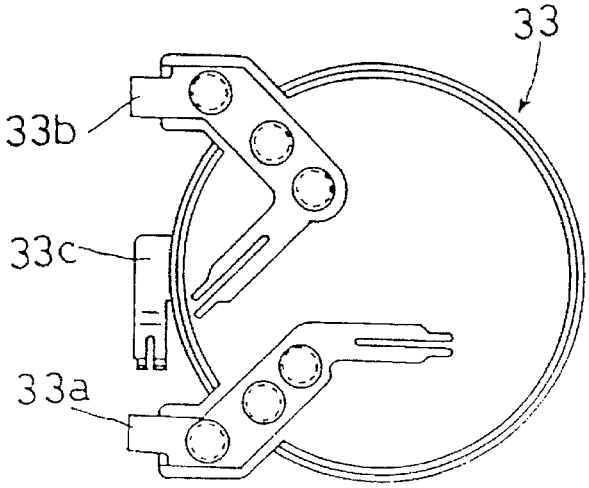

The speaker housing 32 (FIG. 8) has, press fit therein, the piezoelectric vibration plate **21*a* and the terminal unit 33 shown in FIG. 9. The sound generated from the piezoelectric vibration plate 21*a* is released through the openings 32*a*** to the outside.

In the drawings, **32*b* denotes a shielding wall for shielding the components in the box 2 against exposure to the outside through the openings 10, i.e. for preventing entry of foreign matters through the openings 10**.

As shown in FIG. 9, the terminal unit 33 has terminals **33*a*, 33*b* connected to electrodes (+, −) of the piezoelectric vibration plate 21*a* when press fit in the speaker housing 32, and a terminal 33*c* connected to a minus electrode of battery V when the bottom case 2*a* and top case 2*b*** are joined by ultrasonic welding.

FIG. 8(*a*) is a perspective view of the speaker housing 32, FIG. 8(*b*) is a rear view of the speaker housing 32, FIG. 9(*a*) is a perspective view of the terminal unit 33, and FIG. 9(*a*) is a bottom view of the terminal unit 33.

The LED window 34 mounted in a corner of the box 2 has slant surfaces **34*a*, 34*b*, as shown in FIG. 10, for distributing light from one LED lamp 20 in directions of side surfaces 2*d*, 2*e* of box 2 adjacent the LED window 34**.

Figure 19:
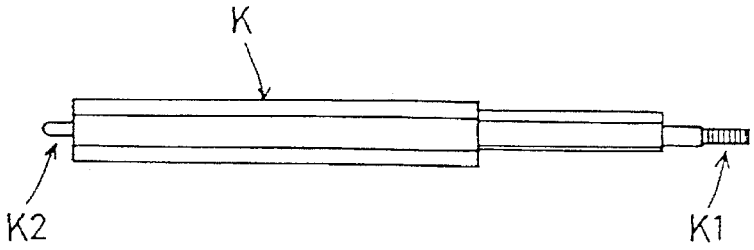
FIG. 19 is a view of an outward appearance of a key in the embodiment of FIG. 1.

As shown in FIG. 11, the jack unit 4 has a key insertion hole 41 for receiving a rack K1 of a key K (see FIG. 19), and a set button pin insertion hole 42 for receiving a projecting pin K2 of key K.

Figure 12A:
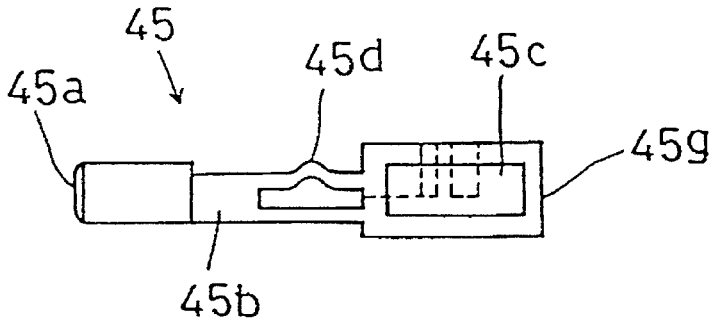
Figure 12B:
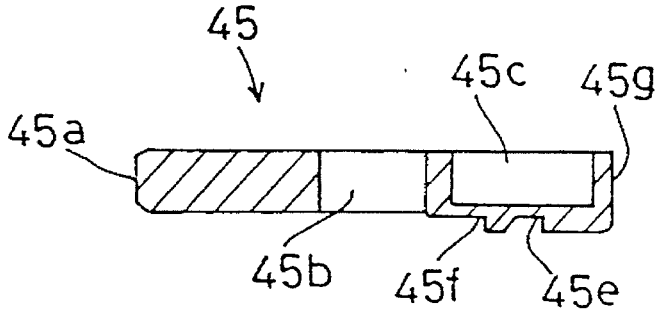
Figure 13:
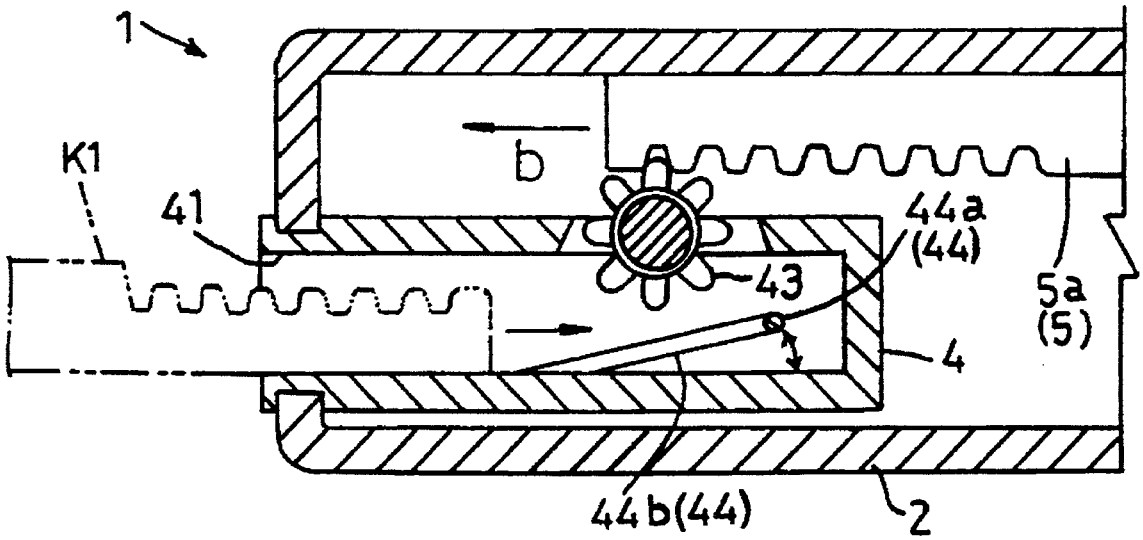
FIG. 13 is an explanatory view of the jack unit in the embodiment of FIG. 1.

As shown in FIG. 13, the key insertion bore 41 has, mounted therein, a pinion gear 43 rotatable by the rack K1 inserted into the key insertion bore 41, and a movement check spring 44 for checking movement of a set button pin 45 mounted in the set button pin insertion bore 42 (see FIG. 12).

The pinion gear 43 is rotatably supported in the main body of jack unit 4, with a part thereof projecting into the key insertion bore 41, and the other part projecting outside the jack unit 4.

FIG. 11(*a*) is a perspective view of the jack unit 4, and FIG. 11(*b*) is a side view of the jack unit 4.

The set button pin insertion bore 42 has the set button pin 45 slidably mounted in the set button pin insertion bore 42. A contact spring 46 formed of metal is attached to an end of the set button pin insertion bore 42 to be vertically pivotable when pushed by the set button pin 45.

As shown in FIG. 12, the set button pin 45 includes an operated portion 45*a* pushed from outside the box 2, a positioning portion 45*b* for positioning the set button pin 45 in a particular location inside the set button pin insertion bore 42, a spring storing portion 45*c* storing a coil spring 47 (FIG. 14) for biasing the set button pin 45 in a direction opposite to the inserting direction of the pin K2, and an end 45*g* for pushing the contact spring 46 to swing the contact spring up and down.

FIG. 12(*a*) is a plan view of the set button pin 45, and FIG. 12(*b*) is a sectional view of the set button pin 45.

Figure 14:
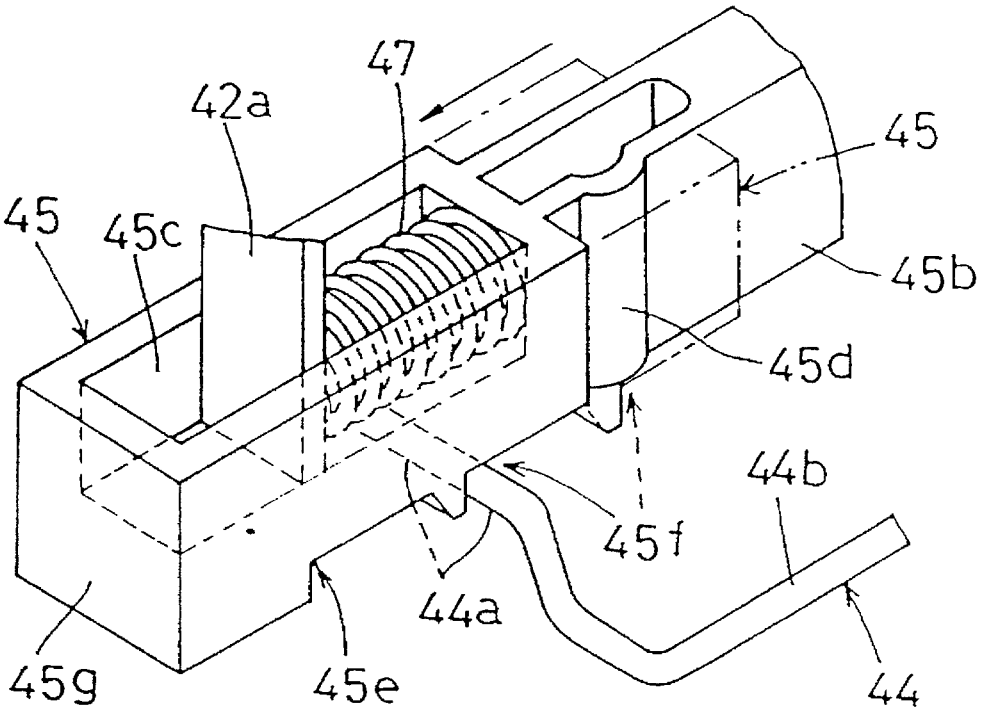
FIG. 14 is a perspective view of a principal portion of the embodiment of FIG. 1.

As shown in FIG. 14, a projection 42*a* is formed in a space defined by the spring storing portion 45*c* and inner walls of the set button pin insertion bore 42 to project from the inner walls of the set button pin insertion bore 42 to check movement in the sliding direction of the set button pin 45.

As shown in FIG. 14, the coil spring 47 is disposed between inner walls of the spring storing portion 45*c* and the projection 42*a*. Thus, as noted hereinbefore, the set button pin 45 is biased in the direction opposite to the inserting direction of the pin K2.

The positioning portion 45*b* of set button pin 45 has a positioning bulge 45*d* having elasticity to be movable in the projecting direction. An inner wall of the set button pin insertion bore 42 includes a recess 42*b* for engaging the positioning bulge 45*d* when the set button pin 45 is pushed.

When the set button pin 45 is pushed, the end 45*g* of set button pin 45 contacts the contact spring 46 to swing the contact spring 46 up and down. With this swinging movement, a free end of contact spring 46 touches the circuit board 30. As a result, the two terminals on the circuit board 30 are short-circuited.

The short circuit of the two terminals causes power to be supplied from battery V each circuit in the box 2. This contact spring 46 corresponds to the power supply switch 6 in FIG. 1.

As shown in FIGS. 13 and 14, the jack unit 4 has the movement check spring 44. The movement check spring 44 is formed of a thin metal piece to be elastically deformable. One end is fixed to one side of the key insertion bore 41 to act as a proximal end, and the other end is a free end 44*a* pivotable through elastic deformation.

As shown in FIG. 14, when the set button pin 45 is pushed, the free end 44*a* of the movement check spring 44 is pressed by the elastic action of movement check spring 44, against an engaging portion 45*e* formed on an outer surface of the spring storing portion 45*e* of set button pin 45. An intermediate portion 44*b* between the proximal end and free end 44*a* of movement check spring 44 extends across the key insertion bore 41.

Figure 15:
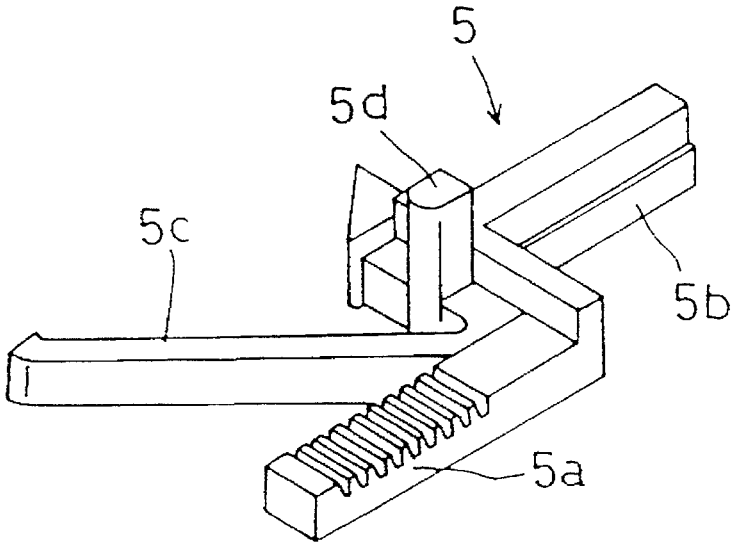
FIG. 15 is an explanatory view of an outward appearance of a slider in the embodiment of FIG. 1, FIGS. 16(*a*), (*b*) are sectional views of the principal portion of the embodiment of FIG. 1, FIGS. 17(*a*), (*b*) are sectional views of the principal portion of the embodiment of FIG. 1, FIGS. 18(*a*), (*b*) are sectional views of the principal portion of the embodiment of FIG. 1.

Top case 2*b* includes a slider 5 (see FIG. 15) having a rack 5*a* meshed with the pinion gear 43 of jack unit 4.

Figure 5:
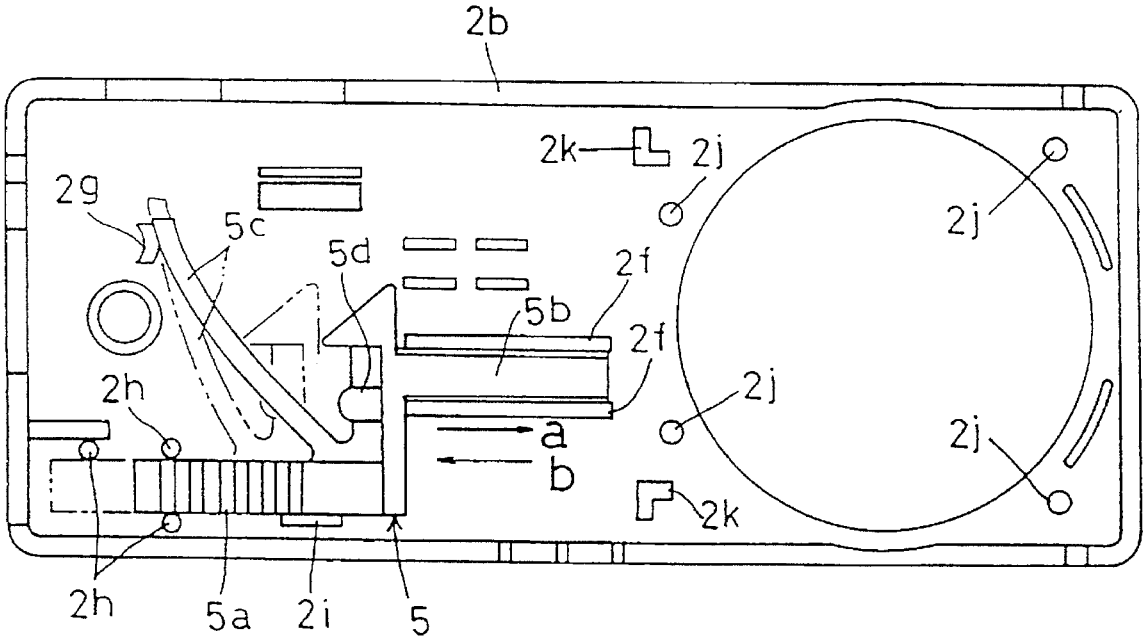
FIG. 5 is a plan view of the top case in the embodiment of FIG. 1, FIGS. 6(*a*), (*b*) are explanatory views of a switch in the embodiment of FIG. 1, FIGS. 7(*a*), (*b*) are sectional side views of the switch in the embodiment of FIG. 1, FIGS. 8(*a*), (*b*) are explanatory views of outward appearances of a speaker housing in the embodiment of FIG. 1, FIGS. 9(*a*), (*b*) are explanatory views of outward appearances of a terminal unit in the embodiment of FIG. 1.

As shown in FIG. 5, the slider 5 has a proximal portion 5*b* thereof slidably engaging a guide portion 2*f* formed on an inner wall of the top case 2*b*, which is slidable in two directions indicated by arrows a, b. A forward end of an elastically deformable extension 5*c* extending from an intermediate portion between rack 5*a* and proximal portion 5*b* engages an engaging portion 2*g* of the top case 2*b*, so that the elasticity of the extension 5*c* applies a biasing force in the direction of arrow a.

In the drawings, 2*h* and 2*i* denote projections for preventing inclination of slider 5. 2*j* denotes projections for holding the speaker housing 32 in place. 2*k* denotes projections for reinforcing contact between terminals 33*a*, 33*b* and terminals on the circuit board 30. When the bottom case 2*a* and top case 2*b* are joined by ultrasonic welding, the projections 2*k* press the terminals 33*a*, 33*b* to the circuit board.

To start operation of the sensor tag 1, the set button pin 45 is pushed with the projection pin K2 of key K to turn on the power supply switch 6. A mechanism for maintaining the power supply switch 6 in the ON state will be described next.

Figure 16A:
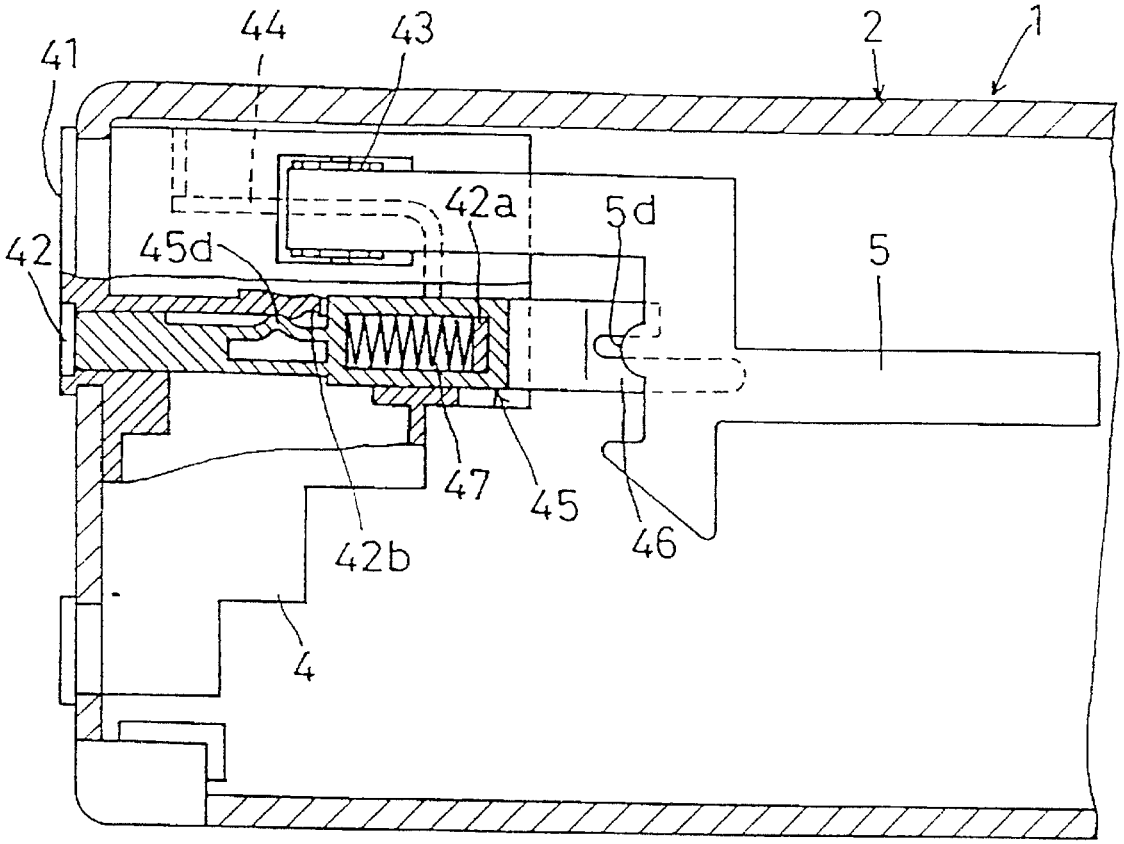
Figure 16B:
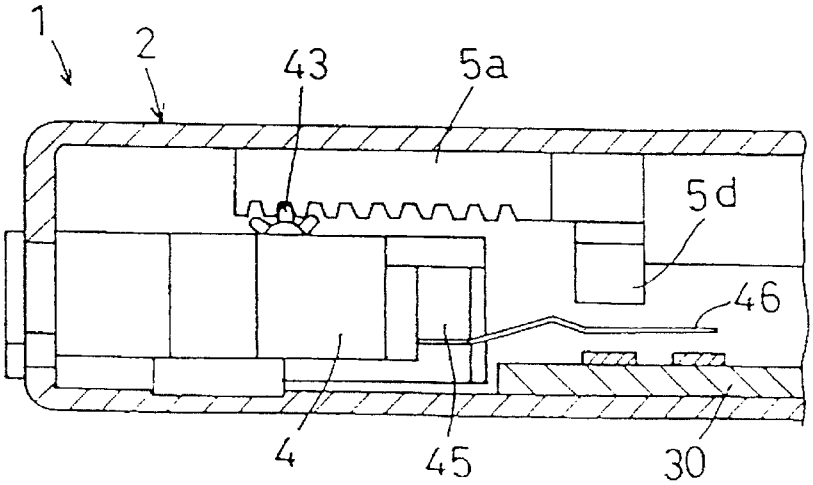

The set button pin 45 is maintained at first in the position shown in FIG. 16, with the free end of movement check spring 44 engaged with an engaging portion 45*f* of set button pin 45.

Figure 17A:
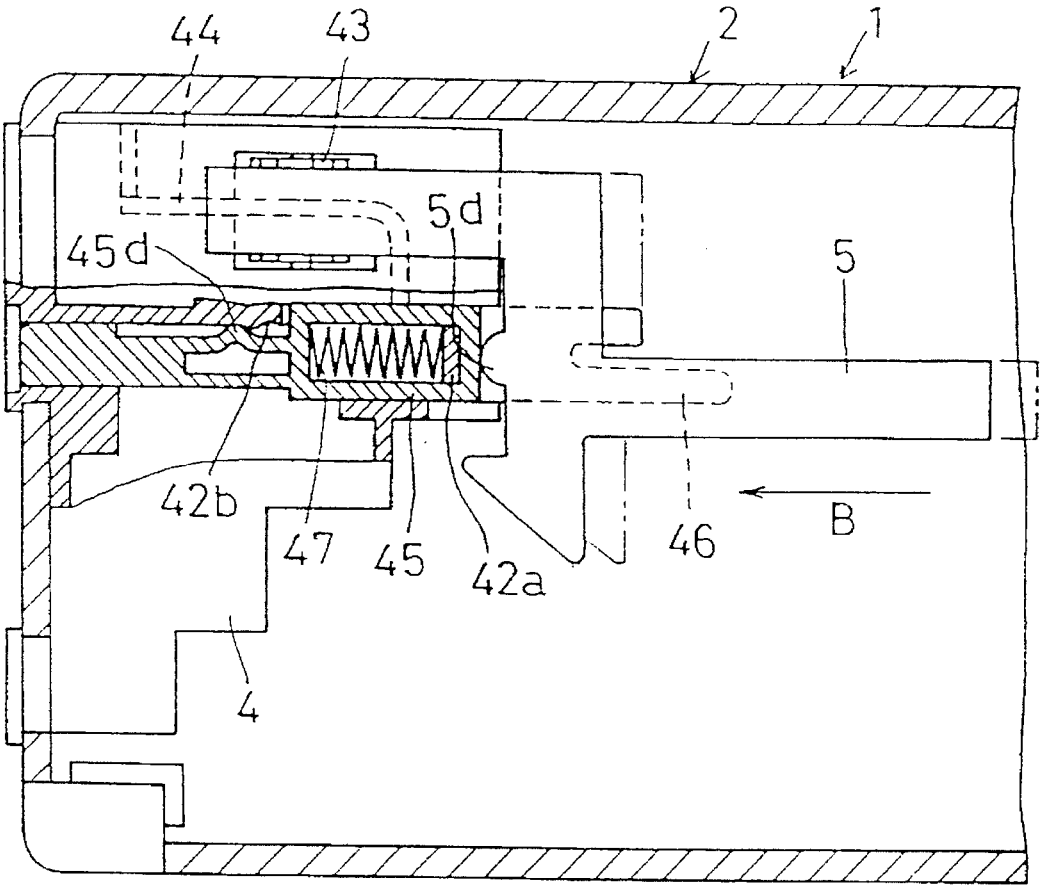
Figure 17B:
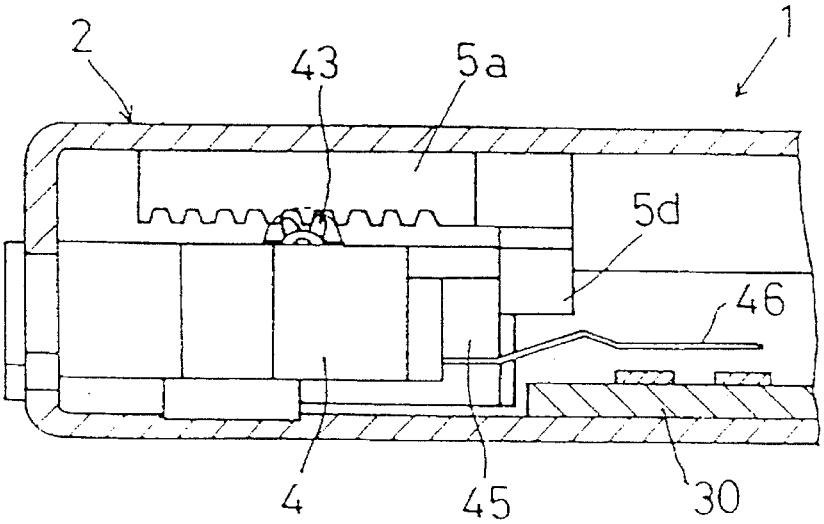

When operated portion 45*a* of set button pin 45 in the jack unit 4 is pushed into the depth with the projection pin K2 of key K, as shown in FIG. 17, the end 45*g* of set button pin 45 contacts the contact spring 46, and swings the contact spring 46. With this swinging movement, the free end of contact spring 46 touches the circuit board, and causes a short circuit between the two terminals on the circuit board.

This turns on the power supply switch 6, and starts the power supply from the battery V to each circuit in the main case 101.

When the set button pin 45 is pushed then, the coil spring 47 is compressed to push back the set button pin 45 outside the box 2 (in the direction opposite to the inserting direction of set button pin 45). However, the engaging bulge 45*d* of set button pin 45 and engaging recess 42*d* of set button pin insertion bore 42 engage each other, and the free end 44*a* of movement check spring 44 extending from the key insertion bore 41 engages the engaging portion 45*e* on the outer surface of spring storing potion 45*c*. Consequently, that position is maintained against the biasing force of coil spring 47.

A mechanism for turning off the power supply switch 6 to stop the operation of sensor tag 1 will be described next.

In the state shown in FIG. 17, when the rack K1 is inserted into the key insertion bore 41, the rack K1 presses the movement check spring 44 extending across the key insertion bore 41, and rotates the pinion gear 43 meshed with the the rack K1.

When the rock K1 presses the intermediate portion 44*b* of movement check spring 44, the intermediate portion 44*b* of movement check spring 44 pushed against a wall of the key insertion born 41. As a result, the free end 44*a* of movement check spring 44 pivots downward, whereby the free end 44*a* and the engaging portion 45*e* of set button pin 45 are disengaged.

Figure 18A:
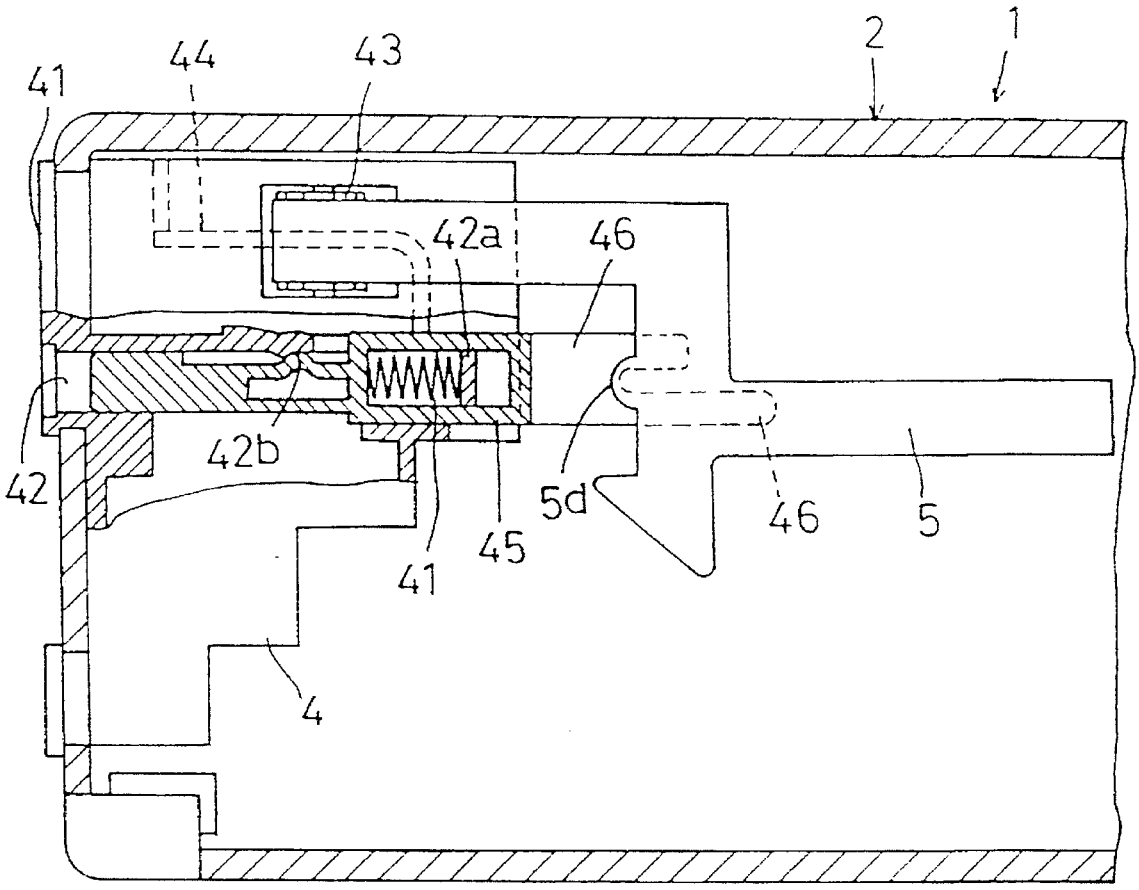
Figure 18B:
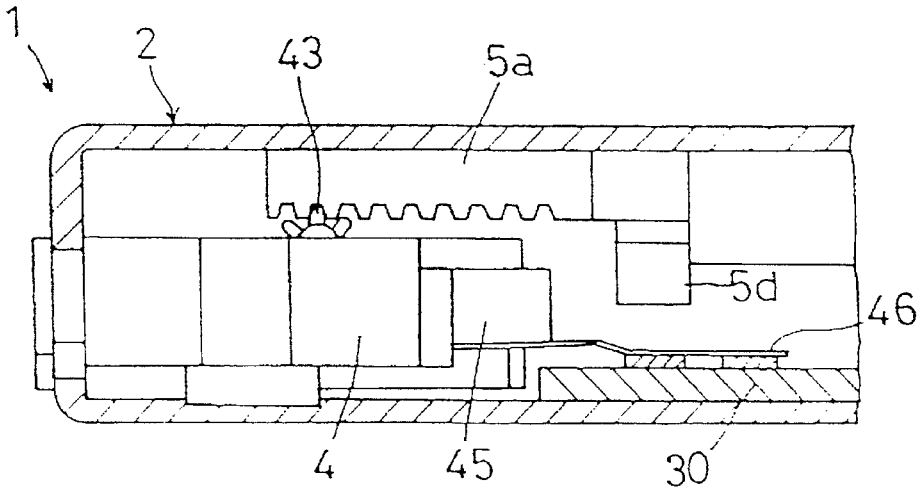

When the pinion gear 43 is rotated by the rack K1, as shown in FIG. 18, the rotation of pinion gear 43 causes the slider 5 having the rack 5*a* engaged with the pinion gear 43 moves in the direction of arrow b.

The slider 5 has a presser portion 5*d* for contacting the end 45*g* of set button pin 45 with the sliding movement in the direction of arrow b of slider 5. When the presser portion 5*d* pushes the end 45*g* of set button pin 45, the set button pin 45 moves outwardly of the box 2 (in the direction opposite to the direction in which the set button pin 45 is inserted). Consequently, the engaging bulge 45*d* of set button pin 45 and engaging recess 42*b* of set button pin insertion bore 42 are disengaged.

As a result, by the return biasing force of coil spring 47 in the spring storing portion 45*c*, the set button pin 45 returns to the state before the projection pin K2 is inserted (the state of FIG. 16). The contact spring 46 is separated from the two terminals on the circuit board, thereby stopping the power supply from the battery V to each circuit in the box 2.

When the rack K1 is withdrawn from the key insertion bore 42, the slider 5 having slid in the direction of arrow b returns to the original position (the position in FIG. 16) under a biasing force acting in the direction of arrow a due to the elasticity of extension 5*c*.

FIG. 16, FIG. 17 and FIG. 18(*a*) are sectional plan views. FIG. 16, FIG. 17 and FIG. 18(*b*) are sectional side views.

Other embodiments are listed below.

(1) In the above embodiment, the switch 3 is provided on the upper surface 2*c* of box 2. However, the position of switch 3 is not limited to the upper surface 2*c*, but may be on a different, side surface. As shown in FIG. 23, for example, switch 3 may be provided on the side surface 2*d* of box 2.

(2) With the above embodiment, it is impossible to detect a preliminary stealing act to insert a thin plate-like foreign object such as a ruler between sensor tag 1 and object of theft prevention E in order not to allow the operated portion 3*a* of switch 3 to project from the contact surface. To detect such a preliminary stealing act, the contact surface 2*c* may have a plurality of projections 2*m* surrounding the operated portion 3*a* and extending into the object of theft prevention E.

In this case, the object of theft prevention E should be an object capable of receiving the projections 2*m* (such as a cardboard box).

(3) In the above embodiment, the operated potion 3*a* of switch 3 is pivotable in two opposite directions e1, e2, but may be pivotable in other directions as well.

(4) In the above embodiment, and an alarm is outputted by lighting LED lamp 20 and sounding piezoelectric buzzer 21. However, an alarm may be outputted only with piezoelectric buzzer 21. Further, the box 2 may have a transmitting device for transmitting an electric wave, with a device placed in a selected location for receiving the electric wave from the transmitting device and giving an alarm. In this case, an alarm is outputted by transmitting the electric wave from the transmitting device when the sensor tag 1 is detached from the object of theft prevention E.

(5) The alarm outputting device may comprise, instead of piezoelectric buzzer (piezoelectric type buzzer) 21, a different type of buzzer such as the electromagnetic type (but not transmitting an electric wave).

(6) In the above embodiment, openings 10 are formed in the side surface 2*n* of box 2. However, openings may be formed in a different side surface (such as side surface 2*d*) as well for releasing the alarm sound.

Then, the openings cannot be blocked up easily, thereby positively preventing a preliminary stealing act to cancel the alarm sound and walk out with the object of theft prevention.

(7) In the above embodiment, the alarm device A receives a signal from the resonance antenna 22, and sounds the piezoelectric buzzer 21 and light LED lamp to give an alarm. However, an electric wave signal my be transmitted upon receipt of the signal from the resonance antenna 22, with a separate device provided to receive the electric wave signal and give an alarm sound or the like.

(8) In the above embodiment, when adjusting the reception sensitivity of resonance antenna 22 by varying the resistance value of resistor R, the adjustment is made by replacing the resistor R with an appropriate one. However, a variable resistor may be used as resistor R, the reception sensitivity of the resonance antenna being adjusted by adjusting the resistance value of the variable resistor.

We claim:

1. A detector for theft prevention comprising a box attached in contact with an object of theft prevention, and a switch provided for this box for detecting whether it is detached from said object of theft prevention, wherein said switch provided for said box has a pivotable operated portion biased to return to a position projecting from a surface contacting said object of theft prevention, and said operated portion is pivotable in a plurality of directions including at least two opposite directions, one of said opposite directions being a direction projecting from a surface of said box and the other of said opposite directions being a direction retracting from the surface, and a third direction different from the opposite directions, wherein said switch further includes an elastic member disposed downwardly of the operated portion for effecting pivotal movement of the operated portion in the projecting and retracting directions.

2. A detector for theft prevention as defined in claim 1, wherein said operated portion has an approximately triangular shape with one end projecting from said contact surface, and is supported between a frame providing said switch and formed of a non-conductive material to have a box-like shape, and said elastic member is supported by a boss portion of said frame to be pivotable about a transverse axis.

3. A detector for theft prevention as defined in claim 1, wherein said contact surface has a plurality of projections surrounding said operated portion to extend into said object of theft prevention.

4. A detector for theft prevention as defined in claim 1, wherein said box has a battery for supplying electricity to an alarm sound output means and said alarm sound output means opposed to each other therein, and a plate-like terminal unit having a terminal connected to an electrode of said battery and a terminal connected to an electrode of said alarm sound output means is provided between said battery and said alarm sound output means.

5. A detector for theft prevention as defined in claim 4, wherein said box has a vibrating plate vibrating in a vibrating direction and sound release openings formed in a side surface thereof for releasing the alarm sound outputted from said alarm sound output means outside said box, said openings being formed transverse to the vibrating direction of the vibrating plate for outputting the alarm sound.

6. A detector for theft prevention as defined in claim 5, wherein said box has a shield wall mounted therein for shielding components in the box against exposure through said openings.

7. A detector for theft prevention as defined in claim 6, wherein said box has light generating means, and said light generating means emits light while said alarm sound output means gives the alarm sound.

8. A detector for theft prevention as defined in claim 4, further comprising a receiver means comprising a resonance antenna for outputting a signal to operate the alarm sound output means upon receipt of an electric wave from an associated transmitter, said receiver means having a coil, a capacitor and a resistor in parallel connection.

9. A detector for theft prevention as defined in claim 8, further comprising an alarm means including an antenna input circuit for outputting a reception signal when said resonance antenna is in reception state, a switching circuit for outputting a control signal upon input of the reception signal from this antenna input circuit or an OFF signal from a switch input circuit outputting the OFF signal indicative of OFF state of said switch, a generating circuit for generating pulses upon input of the control signal from this switching circuit, a counter which starts counting pulses generated by said generating circuit upon input of the control signal from said switching circuit and outputs a count completion signal when the count exceeds a predetermined count, a latch circuit for maintaining said switching circuit in the state for inputting said reception signal or said OFF signal upon input of the count completion signal from this counter, and drive means operating said light generating means and said alarm sound output means upon input of the count completion signal from said counter.

10. A detector for theft prevention comprising a box attached in contact with an object of theft prevention, and a switch provided for this box for detecting whether it is detached from said object of theft prevention, wherein said switch provided for said box has a pivotable operated portion biased to return to a position projecting from a surface contacting said object of theft prevention, said operated portion being pivotable in a plurality of directions including at least two opposite directions, and wherein said contact surface has a plurality of projections surrounding said operated portion to extend into said object of theft prevention.

* * * * *